US010542612B2

(12) United States Patent
Saveliev et al.

(10) Patent No.: US 10,542,612 B2
(45) Date of Patent: Jan. 21, 2020

(54) DEVICE AND METHOD FOR PROVIDING POWER TO GAS DISCHARGE LAMP

(75) Inventors: Anatoli Saveliev, Zeitlarn (DE); Sven Probst, Aachen (DE)

(73) Assignee: LUMILEDS LLC, San Jose, CA (US)

( * ) Notice: Subject to any disclaimer, the term of this patent is extended or adjusted under 35 U.S.C. 154(b) by 642 days.

(21) Appl. No.: 13/126,256

(22) PCT Filed: Nov. 3, 2009

(86) PCT No.: PCT/IB2009/054877

§ 371 (c)(1),
(2), (4) Date: Apr. 27, 2011

(87) PCT Pub. No.: WO2010/052641

PCT Pub. Date: May 14, 2010

(65) Prior Publication Data

US 2011/0204822 A1 Aug. 25, 2011

(30) Foreign Application Priority Data

Nov. 7, 2008 (EP) ..... 08168612

(51) Int. Cl.
*H05B 41/288* (2006.01)

(52) U.S. Cl.
CPC ..... *H05B 41/288* (2013.01)

(58) Field of Classification Search
CPC ..... H05B 41/2882; H05B 41/386; H05B 41/2928; H05B 41/2887; H05B 41/388;
(Continued)

(56) References Cited

U.S. PATENT DOCUMENTS

2002/0117973 A1* 8/2002 Ito ..... H05B 41/2882 315/219
2004/0113567 A1* 6/2004 Yamauchi ..... H05B 41/2882 315/291

(Continued)

FOREIGN PATENT DOCUMENTS

DE 102004032187 A1 3/2005
EP 1901589 A1 3/2008

(Continued)

OTHER PUBLICATIONS

First Office Action dated Apr. 15, 2013, China Application No. 200980144373.3, 11 pages.

(Continued)

*Primary Examiner* — Renan Luque

(57) ABSTRACT

A device (1) for providing an amount of power to a gas discharge lamp (2) comprises a control circuit (3) for controlling a supply circuit (4) for supplying the power according to a power versus voltage graph (10). A calculator (30) calculates a boundary voltage value as a function of a measured voltage value of a voltage signal that has been measured after a predefined time-interval from a cold start of the gas discharge lamp (2). A more accurate boundary voltage value results in more stability and in less time required to reach a steady state. The calculator (30) may be arranged for calculating the boundary voltage value as a function of a minimum voltage value of the voltage signal and of a steady state voltage value of the voltage signal. A memory (31) may store voltage values of the voltage signal and a processor (32) may update these voltage values.

21 Claims, 6 Drawing Sheets

(58) Field of Classification Search
CPC ..... H05B 41/2824; H05B 41/2855; H05B 41/288; H05B 41/382; H05B 41/2881; H05B 41/2925; H05B 41/2985; H05B 41/3928
USPC ..... 315/209 R, 224, 244, DIG. 7, 291, 307, 315/308
See application file for complete search history.

(56) References Cited

U.S. PATENT DOCUMENTS

| | | | | |
|---|---|---|---|---|
| 2004/0217717 | A1* | 11/2004 | Breuer | H05B 41/2883 315/291 |
| 2005/0029964 | A1* | 2/2005 | Ishibashi | H05B 41/386 315/291 |
| 2005/0088114 | A1* | 4/2005 | Okura | H05B 41/2882 315/291 |
| 2006/0012318 | A1 | 1/2006 | Ichikawa et al. | |
| 2006/0197473 | A1 | 9/2006 | Fukuwa | |
| 2007/0210723 | A1* | 9/2007 | Kumagai | H05B 41/288 315/209 M |
| 2008/0192211 | A1 | 8/2008 | Kitagawa | |
| 2008/0205055 | A1 | 8/2008 | Schug | |
| 2009/0206775 | A1* | 8/2009 | Green | H05B 41/392 315/307 |

FOREIGN PATENT DOCUMENTS

| | | | |
|---|---|---|---|
| JP | 4272696 | A | 9/1992 |
| JP | 2006302829 | A | 11/2006 |
| JP | 2007005022 | A | 1/2007 |
| JP | 2006073310 | A | 8/2008 |
| JP | 2006164677 | A | 8/2008 |
| JP | 2008243469 | A | 10/2008 |

OTHER PUBLICATIONS

Grant Notification dated Oct. 18, 2013, China Application No. 200980144373.3, 3 pages.
Office Action dated Sep. 1, 2015, Japan Application No. 2011-533920, 12 pages.
Office Action dated Apr. 5, 2016, Japan Application No. 2011-533920, 11 pages.
EPO as ISA, PCT/IB2009/054877 filed Nov. 3, 2009, "International Search Report and Written Opinion", dated Oct. 7, 2010, 11 pages.
Office Action dated Jul. 3, 2014, Japan Application No. 2011-533920, 4 pages.
Office Action dated Feb. 13, 2014, Japan Application No. 2011-533920, 4 pages.
Office Action dated Aug. 27, 2013, Japan Application No. 2011-533920, 5 pages.

* cited by examiner

DEVICE AND METHOD FOR PROVIDING POWER TO GAS DISCHARGE LAMP

FIELD OF THE INVENTION

The invention relates to a device for providing an amount of power to a gas discharge lamp. The invention also relates to a system comprising a device, to a method, to a computer program product and to a medium.

Examples of such a device are electronic ballasts, and examples of such a system are power supplies, and/or lights comprising gas discharge lamps. The computer program product may be used in a computer, a microcontroller, and analog and/or digital control circuitry etc. As a result, the device can be any kind of control device.

BACKGROUND OF THE INVENTION

US 2005/0088114 discloses a discharge lamp lighting device. A discharge bulb ballast has a control circuit that includes a turning point detecting unit for detecting a turning point at which a bulb voltage starts rising after switching on a discharge bulb. Immediately after switching on the discharge bulb, a power control unit carries out control in such a manner that the discharge bulb is supplied with first power. When the turning point detecting unit detects that the voltage of the discharge bulb exceeds the turning point, the power control unit supplies the discharge bulb with second power less than the first power.

SUMMARY OF THE INVENTION

It is an object of the invention to provide an improved device. It is a further object of the invention to provide a system comprising an improved device, and to provide an improved method, computer program product, and medium.

According to a first aspect of the invention, a device is provided for providing an amount of power to a gas discharge lamp, the device comprising a control circuit for controlling a supply circuit for supplying the power according to a power versus voltage graph, the power versus voltage graph defining a first state for supplying a first amount of power, the power versus voltage graph defining a second state for supplying a second amount of power, the first state ending at a boundary voltage value of a voltage signal and the second state starting at the boundary voltage value, the control circuit comprising a calculator for calculating the boundary voltage value as a function of a measured voltage value of the voltage signal that has been measured after a predefined time-interval from a cold start of the gas discharge lamp.

A device provides for example a current signal to a gas discharge lamp. As a result, a voltage signal across the gas discharge lamp will be present. The combination of these current and voltage signals defines an amount of power provided to the gas discharge lamp. The device comprises a control circuit for controlling a supply circuit for supplying the power according to a power versus voltage graph. This power versus voltage graph defines a first state for supplying a first amount of power. This power versus voltage graph defines a second state for supplying a second amount of power. A border between these first and second states is situated at a boundary voltage value of the voltage signal present across the gas discharge lamp, also known as turning point voltage value. The control circuit comprises a calculator for calculating the boundary voltage value as a function of a measured voltage value of the voltage signal that has been measured after a predefined time-interval has elapsed. This predefined time-interval is started at a cold start of the gas discharge lamp.

In FIG. 7 of US 2005/0088114, a minimum value of the voltage signal is detected. Then, a predefined voltage value is added to said minimum value, to find a turning point voltage value. This is a relatively inaccurate way to find the turning point voltage value. For a particular kind of lamp, the minimum value appears for example one second after a cold start of the lamp. The minimum value itself as well as its moment of appearance may depend on many circumstances, like a lamp temperature at a start and a lamp age. According to the invention, a more accurate way to find the boundary voltage value has been realized by measuring a voltage value of the voltage signal at a fixed moment in time, such as for example, for a particular kind of lamp, five, six or seven seconds after a cold start of the gas discharge lamp, or such as for example, for a more general kind of lamp, any time value between two and ten seconds, and by calculating the boundary voltage value as a function of this measured voltage value. As a result, an improved device has been created.

A further advantage might be that a more accurate boundary voltage value results in more accuracy and in less time required to reach the steady state.

Instead of measuring the voltage value of the voltage signal present across the gas discharge lamp, a voltage value may be measured of another voltage signal derived from said voltage signal present across the gas discharge lamp. Said derivation may for example be done a voltage divider. The function may take this derivation into account and/or may be based on this derivation. Said calculator can be any kind of analog and/or digital machine in hardware and/or software.

According to an embodiment, the device is defined by the calculator being arranged for calculating the boundary voltage value as a function of a minimum voltage value of the voltage signal and as a function of a steady state voltage value of the voltage signal. By calculating the boundary voltage value as a function of said measured voltage value and of said minimum voltage value and said steady state voltage value, an even more accurate boundary voltage value will be determined, owing to the fact that three functions are combined.

Alternatively, only one of the functions of the minimum voltage value of the voltage signal and of the steady state voltage value of the voltage signal may be combined with the function of the measured voltage value of the voltage signal. Preferably, each function may be of the type $f(x)=p\,x+q$ with p and q being selected per function. In other words, each function f(x) may comprise a term $p\,x+q$ with p and q being selected per function.

Further alternatively, the boundary voltage value may be calculated as a function of more than one minimum voltage value of the voltage signal. Two or more minimum voltage values of the voltage signal may occur for two or more different situations, such as for example two or more different starting temperatures of the lamp. Each minimum voltage value of the voltage signal may only be a minimum value in a certain time-interval, so the voltage signal may have different minimum values in different time-intervals.

According to an embodiment, the device is defined by the function of the measured voltage value of the voltage signal comprising a first weighting factor, the function of the minimum voltage value of the voltage signal comprising a second weighting factor, and the function of the steady state voltage value of the voltage signal comprising a third weighting factor, a sum of the weighting factors being equal to a predefined value. This way, a most accurate boundary voltage value can be determined.

In case the boundary voltage value is calculated as a function of more than one minimum voltage value of the voltage signal, more than one weighting factor may need to be used, such as for example one weighting factor per minimum voltage value.

According to an embodiment, the device is defined by the first amount of power comprising an increasing amount of power during a first part of the first state while supplying a maximum current to the gas discharge lamp, the first amount of power comprising a maximum amount of power during a second part of the first state, and the second amount of power comprising a decreasing amount of power until the steady state voltage value of the voltage signal has been reached. The increasing amount of power results from increasing voltage values of the voltage signal in combination with the maximum current. The maximum amount of power results from increasing voltage values of the voltage signal in combination with a decreasing current. The decreasing amount of power results from increasing voltage values of the voltage signal in combination with an even more decreasing current.

According to an embodiment, the device is defined by the power versus voltage graph defining a third state for supplying a third amount of power, the third state starting at the steady state voltage value of the voltage signal, the third amount of power comprising a stable amount of power. A stable amount of power is an amount that changes less than for example 1% per second, preferably less than 0.1% per second.

According to an embodiment, the device is defined by the control circuit comprising a memory for storing the measured voltage value of the voltage signal and comprising a processor for updating the measured voltage value stored in the memory. After a start of the gas discharge lamp, a stored measured value is used to calculate a boundary voltage value, and a more recent measured value is used for updating the stored measured value.

According to an embodiment, the device is defined by the control circuit comprising a memory for storing the measured voltage value of the voltage signal and the minimum voltage value of the voltage signal and the steady state voltage value of the voltage signal and comprising a processor for updating the voltage values stored in the memory. After a start of the gas discharge lamp, stored values are used to calculate a boundary voltage value, and more recent values are used for updating the stored values.

According to an embodiment, the device is defined by the device being an electronic ballast for the gas discharge lamp.

According to a second aspect of the invention, a system is provided comprising the device and comprising the supply circuit, in which case the system can be a power supply, and/or comprising the gas discharge lamp, in which case the system can be a light. A combination of a power supply and a light is not to be excluded.

According to a third aspect of the invention, a method is provided for providing an amount of power to a gas discharge lamp, the method comprising a step of controlling a supply of the power according to a power versus voltage graph, the power versus voltage graph defining a first state for supplying a first amount of power, the power versus voltage graph defining a second state for supplying a second amount of power, the first state ending at a boundary voltage value of a voltage signal and the second state starting at the boundary voltage value, the step of controlling comprising a sub-step of calculating the boundary voltage value as a function of a measured voltage value of the voltage signal that has been measured after a predefined time-interval from a cold start of the gas discharge lamp.

According to a fourth aspect of the invention, a computer program product is provided for performing the step of the method.

According to a fifth aspect of the invention, a medium is provided for storing and comprising the computer program product.

Embodiments of the system and of the method correspond with the embodiments of the device.

An insight might be that for a power versus voltage graph of a gas discharge lamp, the boundary voltage value should (also) depend on a relatively stable voltage value of the voltage signal.

A basic idea might be that for a power versus voltage graph of a gas discharge lamp, the boundary voltage value is to be calculated as a function of a measured voltage value of the voltage signal that has been measured after a predefined time-interval from a cold start.

A problem to provide an improved device has been solved.

A further advantage might be that a more accurate boundary voltage value results in more accuracy and in less time required to reach the steady state.

These and other aspects of the invention are apparent from and will be elucidated with reference to the embodiment(s) described hereinafter.

DETAILED DESCRIPTION OF EMBODIMENTS

Figure 1:
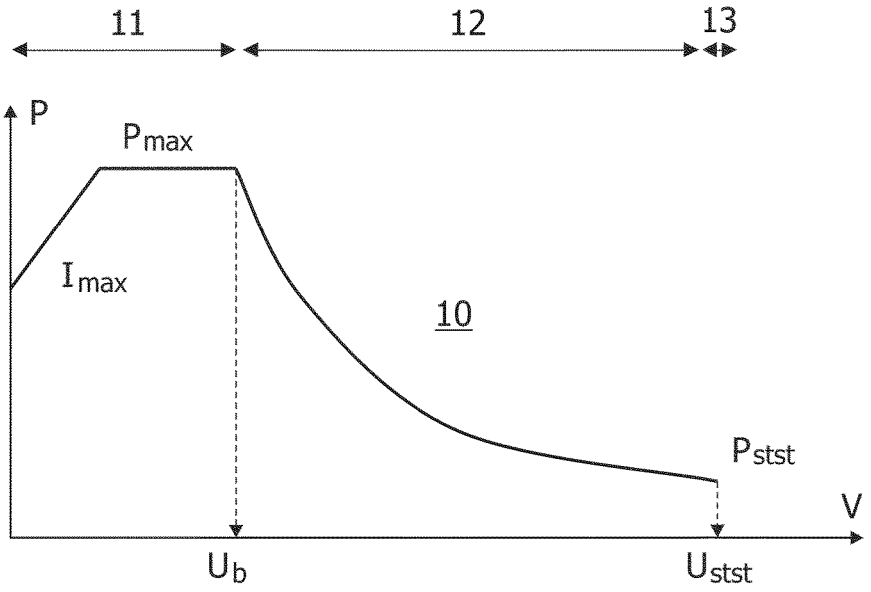
FIG. 1 shows a power versus voltage graph.

In the FIG. 1, a power versus voltage graph 10 of a gas discharge lamp is shown. The power versus voltage graph 10 defines a first state 11 for supplying a first amount of power. The power versus voltage graph 10 defines a second state 12 for supplying a second amount of power. The first state 11 ends at a boundary voltage value $U_b$ of a voltage signal and the second state 12 starts at the boundary voltage value $U_b$. The first amount of power comprises an increasing amount of power during a first part of the first state 11 while supplying a maximum current $I_{max}$ to the gas discharge lamp. The first amount of power comprises a maximum amount of power $P_{max}$ during a second part of the first state 11. The second amount of power comprises a decreasing amount of power until a steady state voltage value $U_{stst}$ of the voltage signal has been reached. The power versus voltage graph 10 defines a third state 13 for supplying a third amount of power. The third state 13 starts at the steady state voltage value $U_{stst}$. The third amount of power comprises a stable amount of power.

Figure 2:
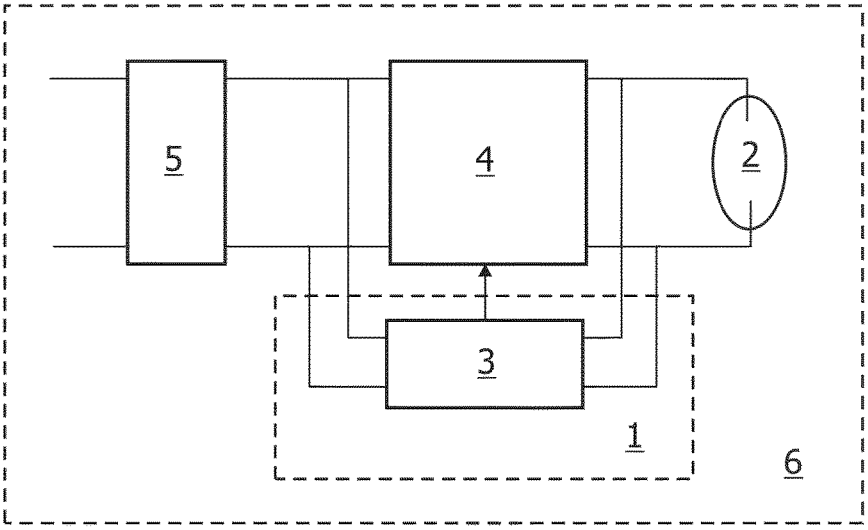
FIG. 2 shows a system comprising a device.

In the FIG. 2, a system 6 is shown comprising a device 1. The system 6 further comprises a gas discharge lamp 2 connected to a supply circuit 4 for supplying an amount of power according to the power versus voltage graph 10 shown in the FIG. 1. Thereto, the supply circuit 4 supplies for example a current signal to the gas discharge lamp 2, which current signal results in a voltage signal across the gas discharge lamp 2. A combination of these current and voltage signals defines an amount of power. The supply circuit 4 is for example connected to a rectifier 5 for rectifying a mains voltage. Alternatively, a battery may be used. The device 1 comprises a control circuit 3 connected to the gas discharge lamp 2 (in parallel to the supply circuit 4) and for example connected to the rectifier 5 (in parallel to the supply circuit 4). A control output of the control circuit 3 is connected to a control input of the supply circuit 4. Between the gas discharge lamp 2 and the supply circuit 4, or in/near the gas discharge lamp 2, or in/near the supply circuit 4, an ignition circuit may be present (not shown).

Figure 3:
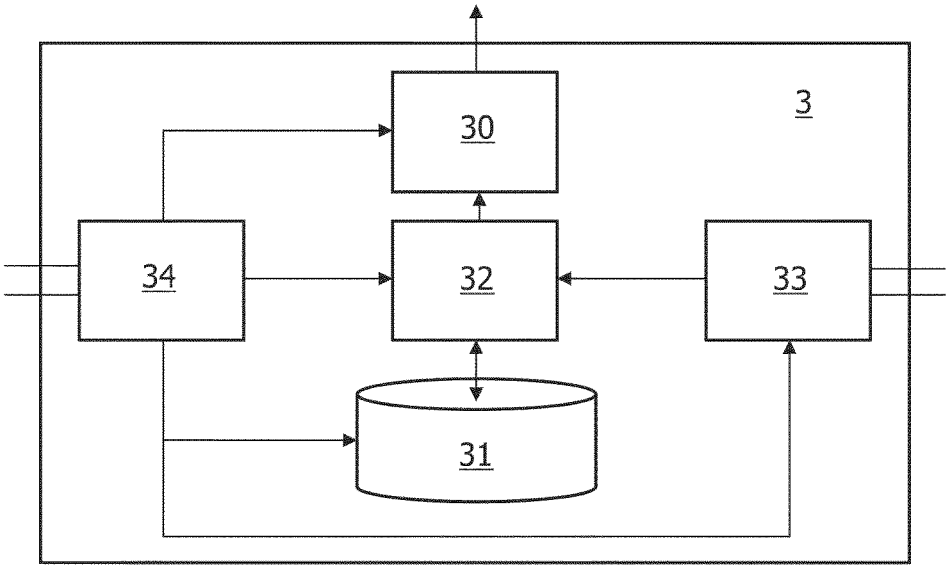
FIG. 3 shows a control circuit.

In the FIG. 3, the control circuit 3 is shown in greater detail. The control circuit 3 comprises a calculator 30 for calculating the boundary voltage value $U_b$ as a function of a measured voltage value $U_T$ of the voltage signal that has been measured after a predefined time-interval from a cold start of the gas discharge lamp 2. According to an option, the calculator 30 may further calculate the boundary voltage value $U_b$ as a function of a minimum voltage value $U_{min}$ of the voltage signal and as a function of a steady state voltage value $U_{stst}$ of the voltage signal. According to a further option, the function of the measured voltage value $U_T$ of the voltage signal comprising a first weighting factor A, the function of the minimum voltage value $U_{min}$ of the voltage signal comprising a second weighting factor B, and the function of the steady state voltage value $U_{stst}$ of the voltage signal comprising a third weighting factor C, a sum of the weighting factors being equal to a predefined value (A+B+C=D, D is for example equal to 1, without having excluded other predefined values).

An output of the calculator 30 constitutes the control output of the control circuit 3 and an input of the calculator 30 is for example connected to a processor 32. The processor 32 is connected to a memory 31 and is for example connected to a voltage determining circuit 33 and a feeding circuit 34. The feeding circuit 34 for example feeds the calculator 30, the memory 31, the processor 32 and the voltage determining circuit 33. The voltage determining circuit 33 determines the measured voltage value $U_T$ of the voltage signal by for example measuring this voltage value after a predefined time-interval from a cold start of the gas discharge lamp 2 in response to an instruction from the processor 32. The voltage determining circuit 33 may further determine other voltage values of the voltage signal by for example measuring these voltage values and supplying the measured voltage values to the processor 32 to for example find the minimum voltage value $U_{min}$ of the voltage signal and the steady state voltage value $U_{stst}$ of the voltage signal by for example comparing the measured voltage values with each other. The processor 32 may thereto comprise an analog comparator or comparing function, alternatively this analog comparator or comparing function may be located inside the voltage determining circuit 33 etc. Alternatively, the voltage determining circuit 33 may comprise an analog to digital converter, and the processor 32 may then comprise a digital comparator or comparing function, alternatively this digital comparator or comparing function may be located inside the voltage determining circuit 33 etc. The calculator 30 may form part of the processor 32, or vice versa.

The memory 31 stores the measured voltage value $U_T$ of the voltage signal and the processor 32 updates the measured voltage value $U_T$ stored in the memory 31. The memory 31 may further store the minimum voltage value $U_{min}$ of the voltage signal and the steady state voltage value $U_{stst}$ of the voltage signal and the processor 32 may further update these voltage values stored in the memory 31. After a start of the gas discharge lamp 2, one or more stored values may be used to calculate the boundary voltage value $U_b$, and one or more recent values may be used for updating the stored values.

The units 30-33 may be hardware units and/or software units and may form part of a computer or a microcontroller or analog and/or digital control circuitry etc.

Figure 4:
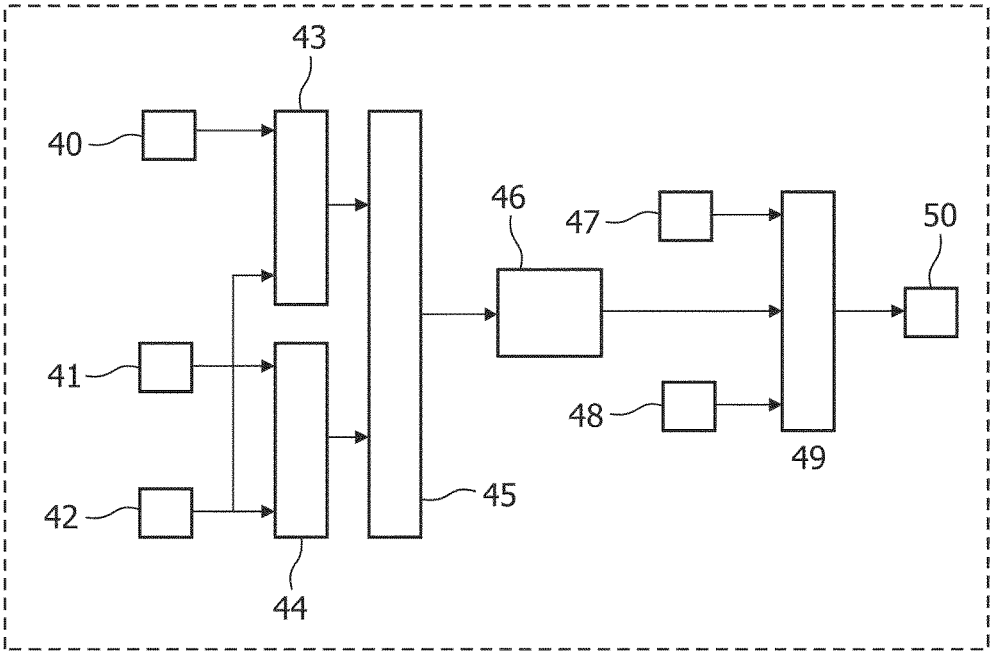
FIG. 4 shows a power defining algorithm.

In the FIG. 4, a power defining algorithm is shown. At a block 40, a measured voltage value U is presented. At a block 41, a (calculated) boundary voltage value $U_b$ is presented. At a block 42, a (measured) steady state voltage value $U_{stst}$ is presented. At blocks 43 and 44 differences are determined, and at a block 45 a division is made such that at the output of the block 45 a normalized voltage value $U_{norm}$ is available:

$U_{norm}=(U-U_{stst})/(U_b-U_{stst})$. Other ways to normalize the voltage are not to be excluded. This normalized voltage value $U_{norm}$ is offered to a block 46 that for example calculates a polynomial $15\ x^3+13\ x^2+7\ x+35$ or any other kind of polynomial. At blocks 47 and 48, a maximum power $P_{max}$ and a minimum power $P_{min}$ are defined, and at a block 49, the information from the blocks 46, 47 and 48 is converted into an output power defined at a block 50 and to be provided to the gas discharge lamp 2. Thereby, according to an embodiment, as long as the calculated polynomial has a value between the maximum power $P_{max}$ and the minimum power $P_{min}$ this value is offered, if said value is larger than the maximum power $P_{max}$, this maximum power $P_{max}$ is offered, and if said value is smaller than the minimum power $P_{min}$, this minimum power $P_{min}$ is offered.

Figure 5:
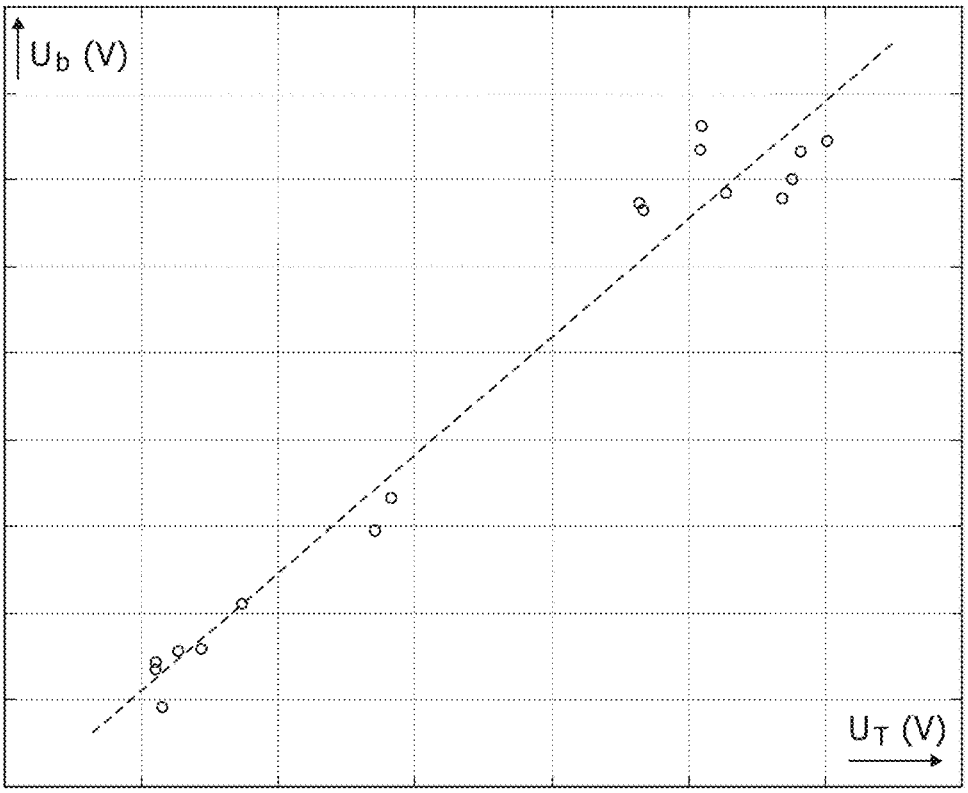
FIG. 5 shows a boundary voltage as a function of a timed voltage.
Figure 6:
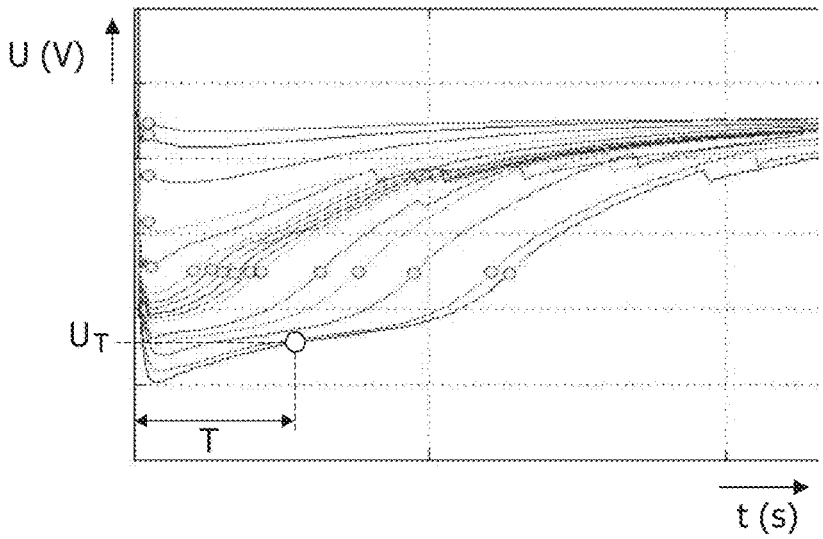
FIG. 6 shows a voltage as a function of a time for FIG. 5.

In the FIG. 5, a boundary voltage $U_b$ (V) as a function of the measured voltage $U_T$ (V) is shown. The measured voltage value $U_T$ of the voltage signal is to be measured after a predefined time-interval T from a cold start of the gas discharge lamp 2. The FIG. 6 shows a voltage U (V) as a function of a time t (s) for the FIG. 5. Clearly, after having measured $U_T$, $U_b$ can be calculated.

Figure 7:
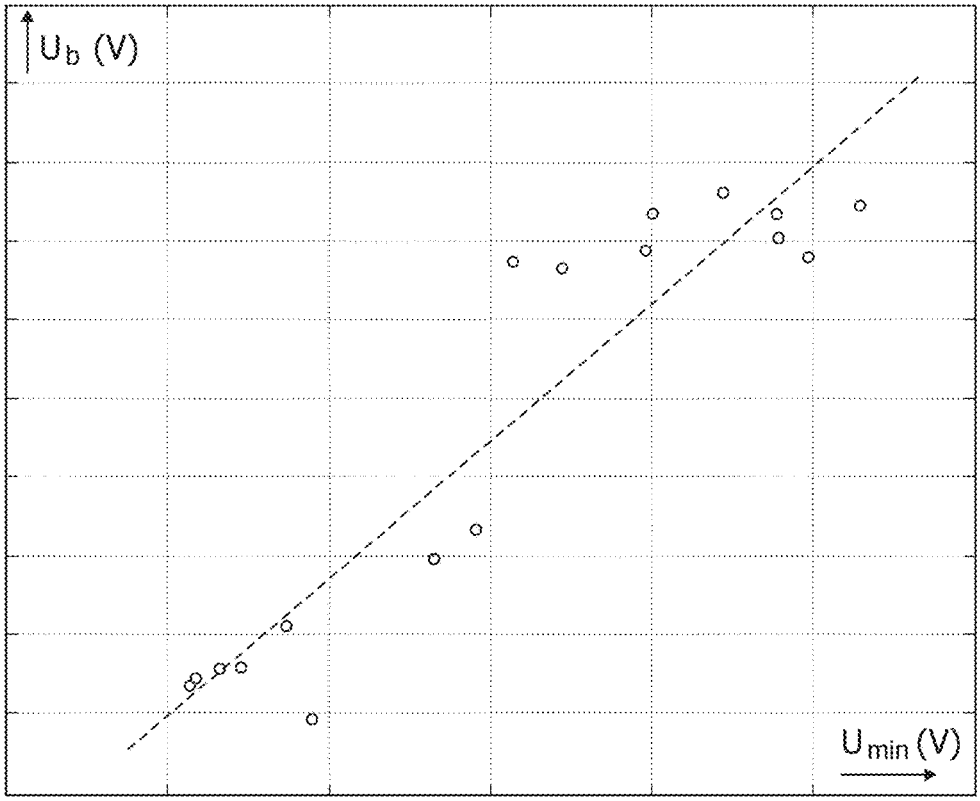
FIG. 7 shows a boundary voltage as a function of a minimum voltage.
Figure 8:
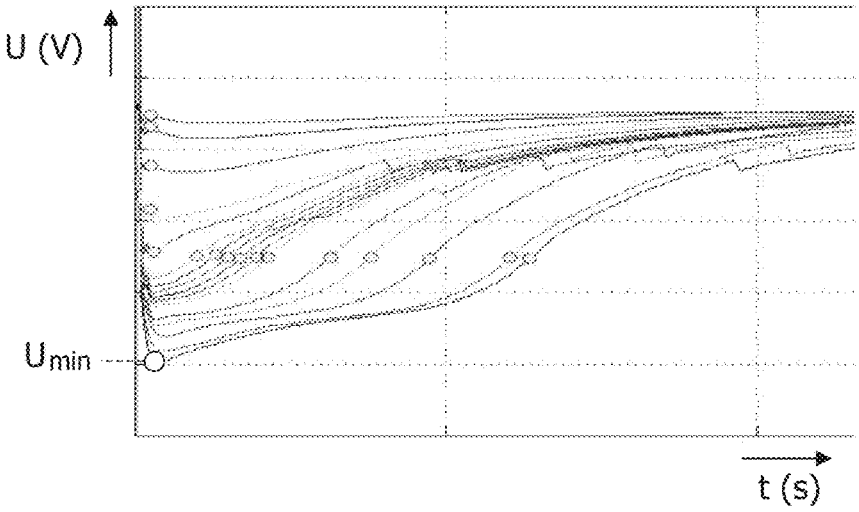
FIG. 8 shows a voltage as a function of a time for FIG. 7.

In the FIG. 7, a boundary voltage $U_b$ (V) as a function of a minimum voltage $U_{min}$ (V) is shown. The FIG. 8 shows a voltage U (V) as a function of a time t (s) for the FIG. 7. Clearly, after having determined $U_{min}$, $U_b$ can be calculated.

Figure 9:
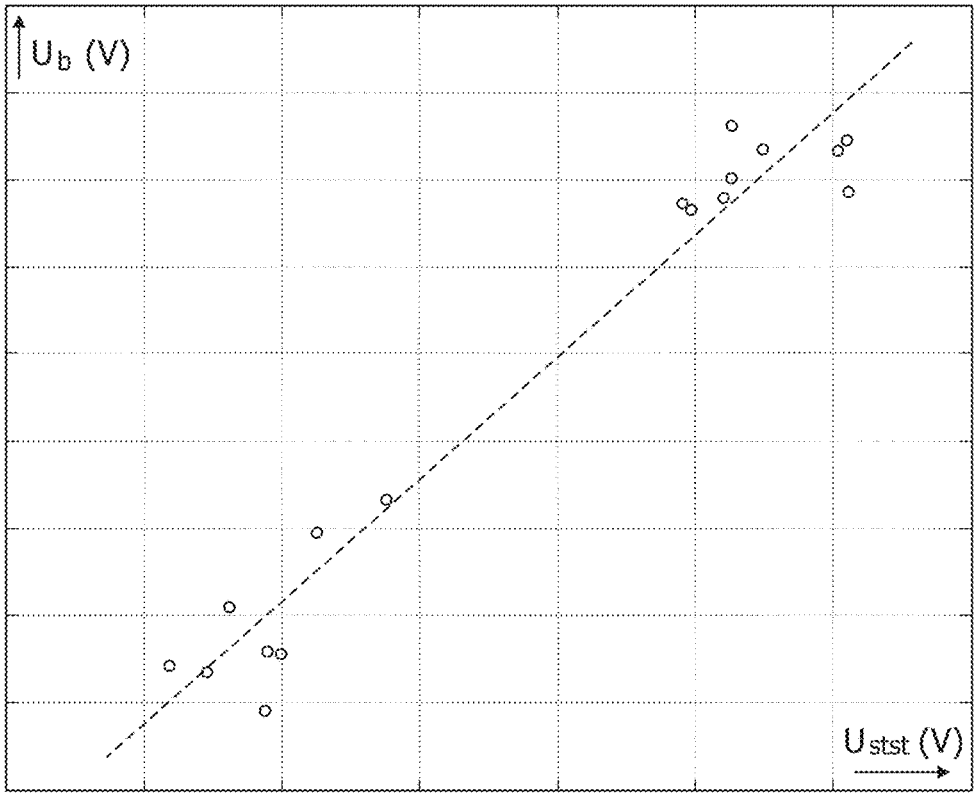
FIG. 9 shows a boundary voltage as a function of a steady state voltage.
Figure 10:
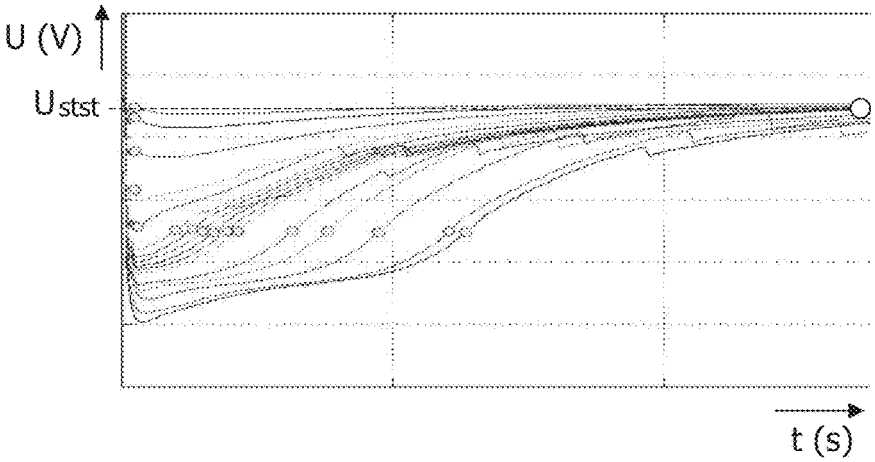
FIG. 10 shows a voltage as a function of a time for FIG. 9.

In the FIG. 9, a boundary voltage $U_b$ (V) as a function of a steady state voltage $U_{stst}$ (V) is shown. The FIG. 10 shows a voltage U (V) as a function of a time t (s) for the FIG. 9. Clearly, after having determined $U_{stst}$, $U_b$ can be calculated.

Figure 11:
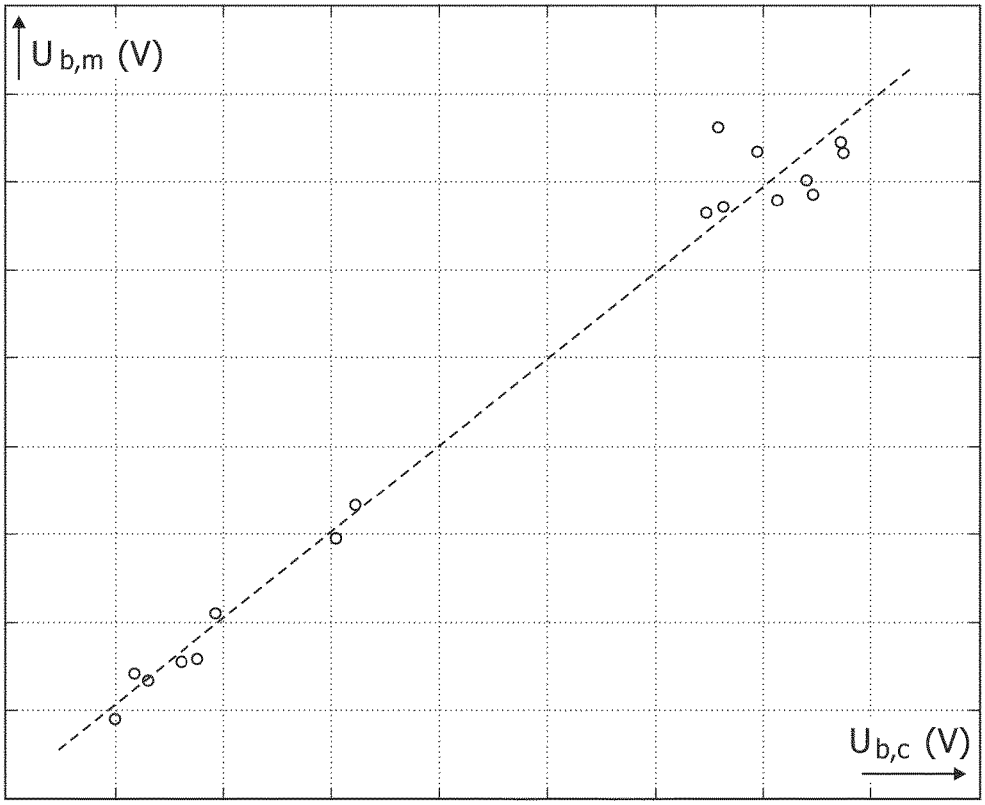
FIG. 11 shows a measured boundary voltage versus a calculated boundary voltage.

In the FIG. 11, a measured boundary voltage $U_{b,m}$ (V) versus a calculated boundary voltage $U_{b,c}$ (V) is shown.

A possible algorithm might be as follows. After the predefined time-interval T, such as for example five, six or seven seconds for a particular kind of gas discharge lamp 2, or such as for example for a more general kind of lamp any time value between two and ten seconds, the voltage value $U_T$ of the voltage signal is to be measured. This measured voltage value $U_T$ of the voltage signal is to be compared with a previous voltage value $U_T$ stored in the memory 31. In response to a first comparison result (non-cold start) the previous voltage value $U_T$ stored in the memory 31 is to be replaced by the measured voltage value $U_T$ of the voltage signal. In response to a different second comparison result (cold start) the previous voltage value $U_T$ stored in the memory 31 is to be replaced by a new voltage value $U_T$ depending on for example the measured voltage value $U_T$ of the voltage signal and one or more, such as for example 20, previously stored voltage values $U_T$.

After another predefined time-interval, such as for example 120 seconds for a particular kind of gas discharge lamp 2, the steady state voltage value $U_{stst}$ of the voltage signal is to be measured. This steady state voltage value $U_{stst}$ of the voltage signal is to be compared with a previous steady state voltage value $U_{stst}$ stored in the memory 31. In response to a first comparison result the previous steady state voltage value $U_{stst}$ stored in the memory 31 is to be replaced by the measured steady state voltage value $U_{stst}$ of the voltage signal. In response to a different second comparison result the previous steady state voltage value $U_{stst}$ stored in the memory 31 is to be replaced by a new steady state voltage value $U_{stst}$ depending on for example the measured steady state voltage value $U_{stst}$ of the voltage signal and one or more previously stored steady state voltage values $U_{stst}$. With the updated voltage values, a new boundary voltage value $U_b$ is to be calculated, and the new boundary voltage value $U_b$ and the new steady state voltage value $U_{stst}$ can be used for a next calculation of the amount of power to be provided etc.

Of course, in addition, after having measured/determined one of the voltage values $U_T$ and $U_{stst}$, a measurement/determination result can be used for updating the (calculated) other one.

After a cold start of an existing particular gas discharge lamp 2, $U_T$ and $U_{stst}$ can be updated. After a non-cold start of the existing particular gas discharge lamp 2, $U_T$ can be kept as it is and $U_{stst}$ can be updated. After a cold start of a novel particular gas discharge lamp 2, $U_T$ and $U_{stst}$ are to be determined. After a non-cold start of the novel particular gas discharge lamp 2, $U_T$ can be kept as it is and $U_{stst}$ can be updated.

Summarizing, a device 1 for providing an amount of power to a gas discharge lamp 2 comprises a control circuit 3 for controlling a supply circuit 4 for supplying the power according to a power versus voltage graph 10. A calculator 30 calculates a boundary voltage value as a function of a measured voltage value of a voltage signal that has been measured after a predefined time-interval from a cold start of the gas discharge lamp 2. A more accurate boundary voltage value results in more accuracy and in less time required to reach a steady state. The calculator 30 may be arranged for calculating the boundary voltage value as a function of a minimum voltage value of the voltage signal and of a steady state voltage value of the voltage signal. A memory 31 may store voltage values of the voltage signal and a processor 32 may update these voltage values.

While the invention has been illustrated and described in detail in the drawings and foregoing description, such illustration and description are to be considered illustrative or exemplary and not restrictive; the invention is not limited to the disclosed embodiments. For example, it is possible to operate the invention in an embodiment wherein different parts of the different disclosed embodiments are combined into a new embodiment.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A device for providing an amount of power to a gas discharge lamp, the device comprising:

a control circuit for controlling a supply circuit for supplying the power to the gas discharge lamp, the control circuit configured to:

from a cold start of the gas discharge lamp, supply a maximum current to the gas discharge lamp;

when the power to the gas discharge lamp reaches a maximum amount of power, supply a decreasing current to maintain the power to the gas discharge lamp at the maximum amount of power;

at a predefined time interval after the cold start of the gas discharge lamp, measure a non-steady state voltage value of a voltage signal across the gas discharge lamp;

calculate a boundary voltage value as a function of the measured, non-steady-state voltage value of the voltage signal; and when the voltage signal reaches the boundary voltage value, supply an even more decreasing current to decrease the power to the gas discharge lamp.

2. The device as claimed in claim 1, wherein the control circuit comprises a calculator being arranged for calculating the boundary voltage value as a function of a minimum voltage value of the voltage signal and as a function of a steady state voltage value of the voltage signal.

3. The device as claimed in claim 2, the function of the measured, non-steady-state voltage value of the voltage signal comprising a first weighting factor, the function of the minimum voltage value of the voltage signal comprising a second weighting factor, and the function of the steady state voltage value of the voltage signal comprising a third weighting factor, a sum of the weighting factors being equal to a predefined value.

4. The device as claimed in claim 2, wherein the control circuit is further configured to, when the voltage signal reaches a steady state voltage value, supply a stable amount of power.

5. The device as claimed in claim 1, the control circuit comprising a memory for storing the measured, non-steady-state voltage value of the voltage signal and comprising a processor for updating the measured, non-steady-state voltage value stored in the memory.

6. The device as claimed in claim 1, wherein said predefined time-interval is not less than 2 seconds.

7. A method for providing an amount of power to a gas discharge lamp, the method comprising:

from a cold start of the gas discharge lamp, supplying a maximum current to the gas discharge lamp;

when the power to the gas discharge lamp reaches a maximum amount of power, supplying a decreasing current to maintain the power to the gas discharge lamp at the maximum amount of power;

at a predefined time interval after the cold start of the gas discharge lamp, measuring a non-steady-state voltage value of a voltage signal across the gas discharge lamp;

calculating the calculating a boundary voltage value as a function of the measured, non-steady-state voltage value of the voltage signal; and when the voltage signal reaches the boundary voltage value, supplying an even more decreasing current to decrease the power to the gas discharge lamp.

8. A computer program product, stored in a non-transitory computer readable medium, for performing the method as claimed in claim 7.

9. An electronic ballast for providing an amount of power to a gas discharge lamp, the ballast comprising:

a supply circuit for supplying the power to the gas discharge lamp;

a control circuit configured to:

from a cold start of the gas discharge lamp, supply a maximum current to the gas discharge lamp;

when the power to the gas discharge lamp reaches a maximum amount of power, supply a decreasing current to maintain the power to the gas discharge lamp at the maximum amount of power;

at a predefined time interval after the cold start of the gas discharge lamp, measure a non-steady-state voltage value of a voltage signal across the gas discharge lamp;

calculate a boundary voltage value as a function of the measured non-steady-state voltage value of the voltage signal; and when the voltage signal reaches the boundary voltage value, supply an even more decreasing current to decrease the power to the gas discharge lamp.

10. The ballast as claimed in claim 9, wherein the control circuit comprises a calculator arranged for calculating the boundary voltage value as a function of a minimum voltage value of the voltage signal and as a function of a steady state voltage value of the voltage signal.

11. The ballast as claimed in claim 9, wherein the control circuit comprises:

a memory for storing the measured, non-steady-state voltage value of the voltage signal; and a processor for updating the measured, non-steady-state voltage value stored in the memory.

12. The ballast as claimed in claim 9, further comprising a memory for storing the measured, non-steady-state voltage value, wherein the control circuit and the memory are hardware units.

13. The ballast as claimed in claim 9, further comprising a memory for storing the measured, non-steady-state voltage value, wherein the control circuit and the memory are software units.

14. The method as claimed in claim 7, further comprising:

comparing the measured, non-steady-state voltage value with a previous voltage value stored in a memory;

replacing the previous voltage value stored in memory with the measured, non-steady-state voltage value.

15. The method as claimed in claim 7, further comprising calculating the amount of power to the gas discharge lamp by:

presenting the measured voltage value U;

presenting the calculated boundary voltage value $U_b$;

presenting a steady state voltage value $U_{stst}$;

determining a normalized voltage value $U_{norm}=(U-U_{stst})/(U_b-U_{stst})$; and calculating a polynomial based on the normalized voltage value, the calculated polynomial corresponding to the power to the gas discharge lamp.

16. The method as claimed in claim 15, further comprising:

defining a maximum power and a minimum power; and comparing the calculated polynomial to the maximum power and minimum power.

17. The method as claimed in claim 16, further comprising:

providing the power corresponding to the calculated polynomial to the gas discharge lamp when the power corresponding to the calculated polynomial is between the maximum power and the minimum power;

providing the minimum power to the gas discharge lamp when the power corresponding to the calculated polynomial is less than the minimum power; and providing the maximum power to the gas discharge lamp when the power corresponding to the calculated polynomial is more than the maximum power.

18. The method as claimed in claim 7, further comprising:

storing in a memory the measured, non-steady-state voltage value;

storing in the memory a minimum voltage value; and storing in the memory a steady state voltage value.

19. The method as claimed in claim 18, wherein calculating the boundary voltage value is based on one or more of the values stored in the memory.

20. The device of claim 1, wherein the pre-defined time interval is between two and ten seconds.

21. The device of claim 1, wherein the boundary voltage value is a turning point voltage value at which a bulb voltage starts rising after switching on the gas discharge lamp.

* * * * *